United States Patent [19]

Matthews et al.

[11] 4,129,464

[45] Dec. 12, 1978

[54] HIGH YIELD STRENGTH NI-CR-MO ALLOYS AND METHODS OF PRODUCING THE SAME

[75] Inventors: Steven J. Matthews, Greentown; H. Joseph Klein; Frank G. Hodge, both of Kokomo, all of Ind.

[73] Assignee: Cabot Corporation, Kokomo, Ind.

[21] Appl. No.: 827,330

[22] Filed: Aug. 24, 1977

[51] Int. Cl.[2] ..... C22C 19/05

[52] U.S. Cl. ..... 148/162; 148/12.7 N; 148/32.5

[58] Field of Search ..... 75/171; 148/162, 11.5 N, 148/12.7 N, 32, 32.5

[56] References Cited

U.S. PATENT DOCUMENTS

| | | | |
|---|---|---|---|
| 2,977,223 | 3/1961 | Brown | 148/162 |
| 3,510,294 | 5/1970 | Bieber et al. | 75/171 |
| 4,043,810 | 8/1977 | Acuncius et al. | 148/162 |
| 4,080,201 | 3/1978 | Hodge et al. | 148/162 |

FOREIGN PATENT DOCUMENTS

| | | | |
|---|---|---|---|
| 956166 | 4/1966 | United Kingdom | 75/171 |

OTHER PUBLICATIONS

Metals Handbook, "Heat Treating, Cleaning, Finishing", vol. 2 8th ed., ASM, p. 300.

*Primary Examiner*—L. Dewayne Rutledge
*Assistant Examiner*—Peter K. Skiff
*Attorney, Agent, or Firm*—Jack Schuman; Joseph J. Phillips

[57] ABSTRACT

A process and an alloy are provided for producing high strength material having good ductility to provide a high strength, corrosion resistant alloy including the steps of (1) preparing a body of material having a composition consisting essentially of by weight, about 13% to 18% chromium, about 13% to 18% molybdenum, less than 0.01% carbon, less than about 6% iron, less than about 1.25% cobalt, less than about 4% tungsten, less than 0.5% aluminum, less than 1% manganese, less than 0.5% silicon, and the balance nickel with usual transient metals and impurities in ordinary amounts, and (2) thereafter aging said body at a temperature in the range about 900° and 1100° F to effect an $A_2B$ ordering reaction in the composition.

10 Claims, 6 Drawing Figures

HIGH YIELD STRENGTH NI-CR-MO ALLOYS AND METHODS OF PRODUCING THE SAME

This invention relates to high yield strength, corrosion resistant Ni-Cr-Mo alloys and methods of producing them and particularly to such alloys having substantially good ductility in combination with high yield strength produced by aging to produce an $A_2B$ ordering reaction.

There are many situations where a high yield strength corrosion resistant material whose ductility is unimpaired is desirable. For example, shafts in centrifuges, marine shafts and propulsion parts, and a great variety of other parts which are subject to loading at low and intermediate temperatures, in corrosive environments, need high yield strength and unimpaired ductility.

I have discovered that certain Ni-Cr-Mo alloys containing low carbon contents can be given unexpectedly high yield strengths without substantially affecting their ductility by aging in the range 900° to 1100° F. to effect an $A_2B$ ordering reaction. Aging below or above this level will not affect the yield strength to any significant degree. The corrosion resistance is essentially not drastically affected by this same aging treatment. It is expected that the $A_2B$ ordering reaction may be effected beginning at about 50 hours at temperatures within the range 900° to 1100° F.

Preferably, I provide in a process for producing a high strength material having substantially good ductility to provide a ductile, high strength, corrosion resistant alloy, the steps comprising: (1) preparing a body of material having a composition consisting essentially of by weight, about 13% to 18% chromium, about 13% to 18% molybdenum, less than 0.01% carbon, less than about 6% iron, less than about 1.25% cobalt, less than about 4% tungsten, less than 0.5% aluminum, less than 1% manganese, less than 0.5% silicon and the balance nickel with usual transient metals and impurities in ordinary amounts, and (2) thereafter aging said body at a temperature in the range about 900° and 1100° F. to effect an $A_2B$ ordering reaction in the composition. Preferably, aging is carried out at 1000° F. for times of about 50 hours and up to about 8000 hours.

In the foregoing general description, I have set out certain objects, purposes and advantages of my invention. Other objects, purposes and advantages will be apparent from a consideration of the following description and the accompanying drawings in which.

Figure 1:
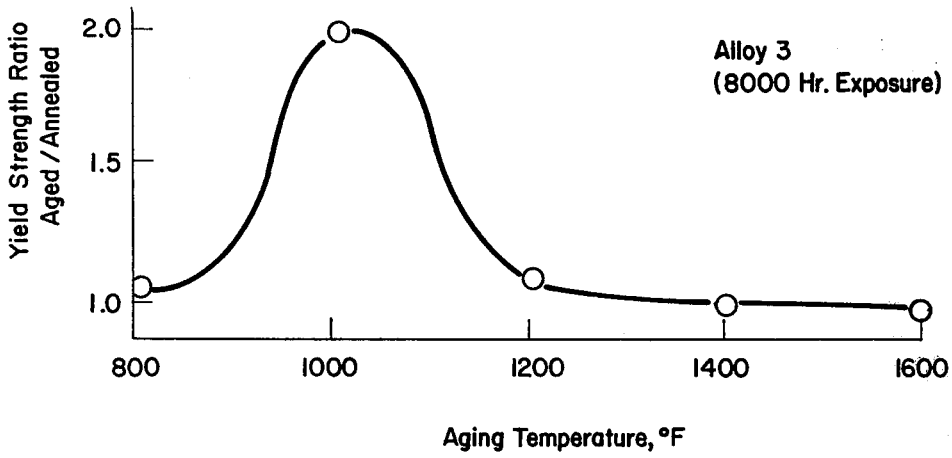
FIG. 1 is a graph of yield strength vs. aging temperature for an alloy composition according to this invention.

Several alloy compositions within the range of this invention were melted, cast and wrought into plates. A group of 5 inch × 5 inch samples of each was aged for various times and temperatures and the physical properties determined.

The compositions of these alloys are set out in Table I hereafter.

TABLE I.

CHEMICAL ANALYSES OF Ni-Cr-Mo, ALLOYS

| Element | Alloy 1 | Alloy 2 | Alloy 3 |
|---|---|---|---|
| Ni | 54.78 | 65.74 | 67.35 |
| Cr | 15.01 | 16.06 | 14.36 |
| Mo | 16.19 | 15.99 | 14.34 |
| C | 0.002 | 0.002 | 0.005 |
| Fe | 5.69 | 0.72 | 0.82 |
| Co | 1.01 | 0.12 | 0.14 |
| W | 3.33 | 0.23 | 0.22 |
| Al | 0.21 | 0.19 | 0.28 |
| Mn | 0.48 | 0.06 | 0.54 |
| Si | 0.04 | 0.04 | 0.37 |
| V | 0.27 | 0.03 | NA |
| B | 0.001 | 0.003 | 0.003 |
| P | 0.025 | 0.03 | 0.005 |
| S | 0.005 | 0.011 | 0.005 |
| Zr | 0.01 | 0.01 | NA |
| Ti | 0.01 | 0.38 | 0.01 |
| Mg | 0.019 | 0.01 | 0.01 |
| Ca | 0.005 | 0.01 | NA |
| Cu | 0.02 | 0.03 | 0.01 |
| Pb | NA | 0.005 | NA |
| La | NA | NA | 0.010 |

The samples were aged in static air, without stress for 1000, 4000 and 8000 hours. Each 5 × 5 inch specimen was then cut into standard samples for testing. The physical properties of the alloys in the annealed condition prior to aging (average of 3 tests) is set out Table II.

TABLE II.

Room Temperature Mechanical Properties Of Alloys In The Mill Annealed Condition (Data Represents An Average of At Least Three Tests)

| Alloy No | Final Anneal Temp. °F | .2% Yield Strength ksi | Ultimate Strength ksi | % Elong. | % R.A. | Charpy Impact Energy (ft.-lbs.) |
|---|---|---|---|---|---|---|
| 3 | 1950 | 52.9 | 125.3 | 53.8 | 63.4 | 140 |
| 2 | 1950 | 55.0 | 123.4 | 54.5 | 70.5 | 223 |
| 1 | 2050 | 52.3 | 115.9 | 62.0 | NA | NA |

The room temperature properties of Alloy 3 after aging (average of three tests) are set out in Table III.

TABLE III.

Room Temperature Tensile Properties of Aged Alloy 3 (.5 Inch Plate) (Data Are Averages of Three Tests)

| Aging Temp. °F | Aging Time Hours | 0.2% Yield Strength ksi | Ultimate Strength ksi | Elongation % | Reduction of Area % |
|---|---|---|---|---|---|
| 800 | 1000 | 55.9 | 125.7 | 59.8 | 57.3 |
| 800 | 4000 | 55.5 | 126.9 | 60.2 | 65.6 |
| 800 | 8000 | 56.6 | 126.7 | 55.4 | 62.5 |
| 1000 | 1000 | 71.5 | 144.4 | 46.1 | 51.5 |
| 1000 | 4000 | 102.5 | 175.0 | 44.4 | 53.8 |
| 1000 | 8000 | 108.2 | 180.8 | 38.1 | 49.1 |
| 1200 | 1000 | 56.6 | 125.1 | 57.3 | 52.3 |
| 1200 | 4000 | 56.4 | 125.8 | 53.9 | 52.5 |
| 1200 | 8000 | 57.0 | 127.2 | 49.8 | 53.4 |
| 1400 | 1000 | 53.7 | 126.0 | 54.9 | 53.5 |
| 1400 | 4000 | 54.1 | 127.4 | 51.7 | 49.8 |
| 1400 | 8000 | 53.5 | 127.5 | 45.9 | 48.3 |
| 1600 | 1000 | 50.8 | 125.8 | 57.7 | 51.8 |
| 1600 | 4000 | 50.7 | 125.2 | 56.4 | 60.6 |
| 1600 | 8000 | 51.3 | 123.5 | 53.1 | 59.9 |

The room temperature properties of Alloy 2 after aging (average of three tests) are set out in Table IV hereafter.

TABLE IV

Room Temperature Tensile Properties Of Aged Alloy 2 (.5 Inch Thick Plate) (Data Are Averages of Three Tests)

| Aging Temp. ° F | Aging Time Hours | 0.2% Yield Strength ksi | Ultimate Strength ksi | Elongation % | Reduction of Area % |
|---|---|---|---|---|---|
| 800 | 1000 | 59.5 | 126.6 | 63.2 | 65.4 |
| 800 | 4000 | 57.0 | 127.0 | 62.7 | 70.5 |
| 800 | 8000 | 60.0 | 128.8 | 59.0 | 62.5 |
| 1000 | 1000 | 113.7 | 191.9 | 41.1 | 50.5 |
| 1000 | 4000 | 113.0 | 194.6 | 39.8 | 50.8 |
| 1000 | 8000 | 116.1 | 197.0 | 35.2 | 46.6 |
| 1200 | 1000 | 82.9 | 156.1 | 44.6 | 47.4 |
| 1200 | 4000 | 71.7 | 146.6 | 48.5 | 50.6 |
| 1200 | 8000 | 86.0 | 160.5 | 42.0 | 47.9 |
| 1400 | 1000 | 59.8 | 129.3 | 53.4 | 52.9 |
| 1400 | 4000 | 57.6 | 134.5 | 46.7 | 43.1 |
| 1400 | 8000 | 60.1 | 132.0 | 41.7 | 44.2 |
| 1600 | 1000 | 54.2 | 125.1 | 61.6 | 57.0 |
| 1600 | 4000 | 54.2 | 124.0 | 58.7 | 57.7 |
| 1600 | 8000 | 55.7 | 122.0 | 54.9 | 56.7 |

The room temperature properties of Alloy 1 after aging (average of three tests) are set out in Table V.

TABLE V.

Room Temperature Tensile Properties Of Aged Alloy 1 (.375 Inch Plate) (Data Are Averages of Three Tests)

| Aging Temp ° F | Aging Time Hours | 0.2% Yield Strength ksi | Ultimate Strength ksi | Elongation % | Reduction of Area % |
|---|---|---|---|---|---|
| 800 | 1000 | 53.2 | 120.6 | 63.6 | 70.1 |
| 800 | 4000 | 51.6 | 120.6 | 72.2 | 80.5 |
| 800 | 8000 | 52.7 | 118.7 | 77.5 | 78.8 |
| 1000 | 1000 | 107.7 | 180.7 | 43.4 | 48.2 |
| 1000 | 4000 | 106.8 | 183.5 | 46.8 | 50.6 |
| 1000 | 8000 | 111.9 | 179.7 | 27.6 | 20.9 |
| 1200 | 1000 | 56.2 | 119.1 | 53.9 | 44.8 |
| 1200 | 4000 | 64.6 | 120.2 | 21.4 | 19.2 |
| 1200 | 8000 | 74.7 | 132.6 | 15.1 | 14.1 |

Figure 2:
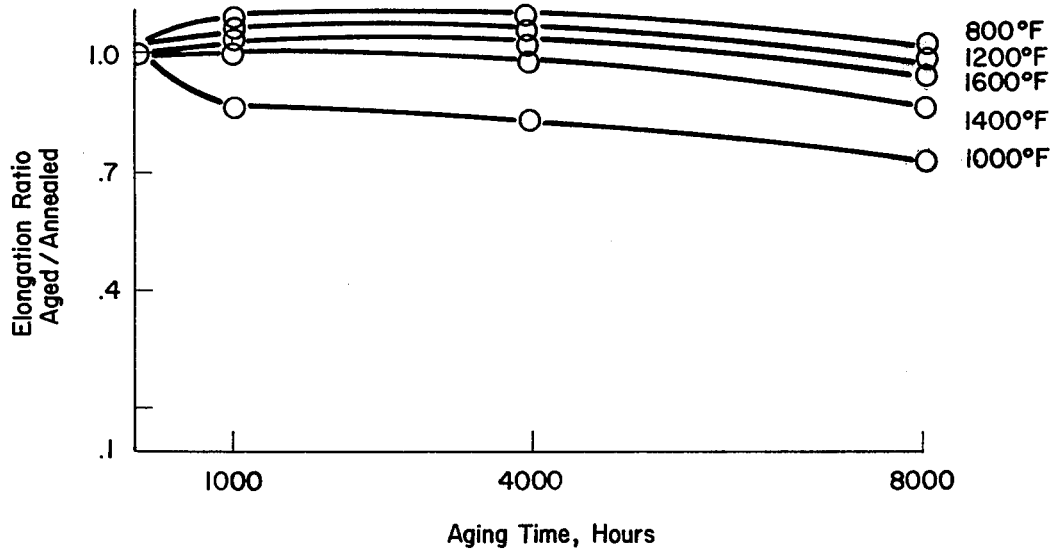
FIG. 2 is a graph of elongation vs. aging time for the composition of FIG. 1.
Figure 3:
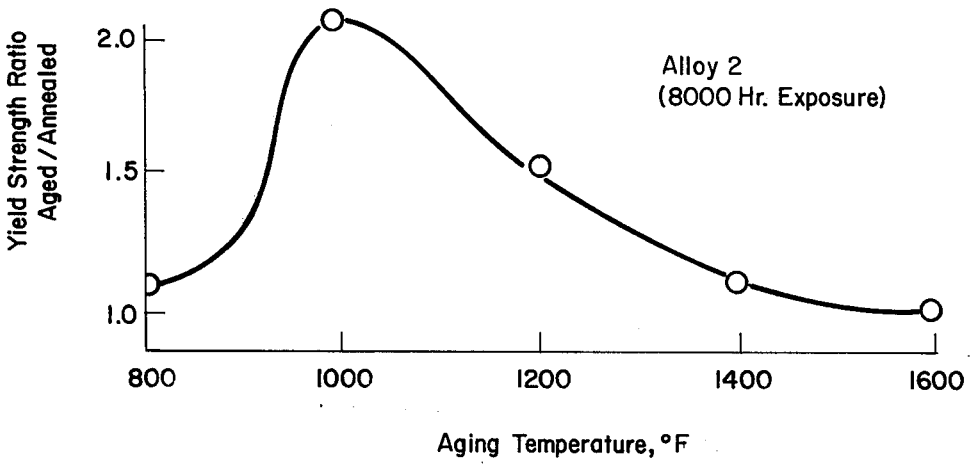
FIG. 3 is a graph of yield strength vs. aging temperature for a second composition according to this invention.
Figure 4:
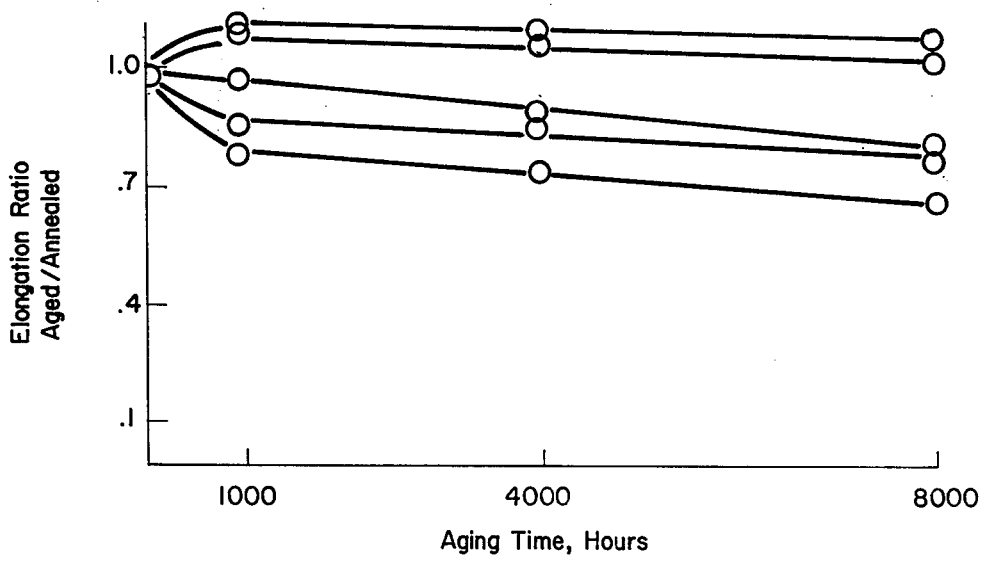
FIG. 4 is a graph of elongation vs. aging time for the composition of FIG. 3.
Figure 5:
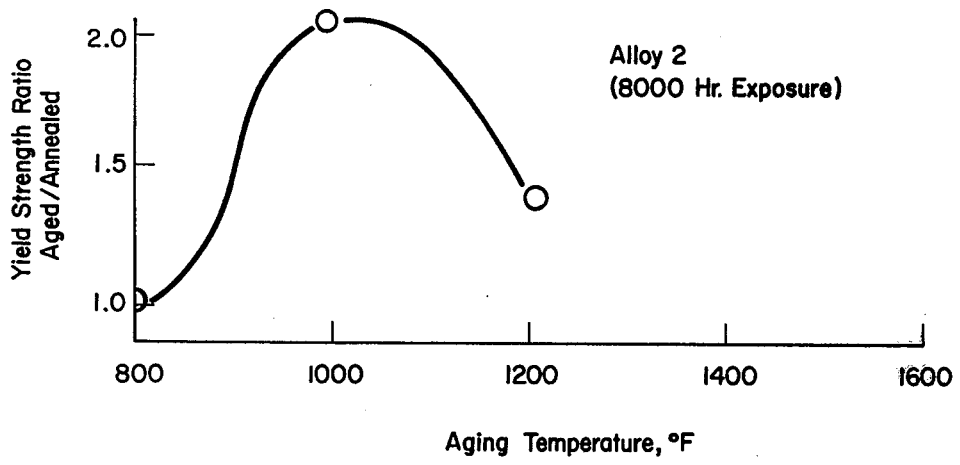
FIG. 5 is a graph of yield strength vs. aging temperature for a third composition according to this invention.
Figure 6:
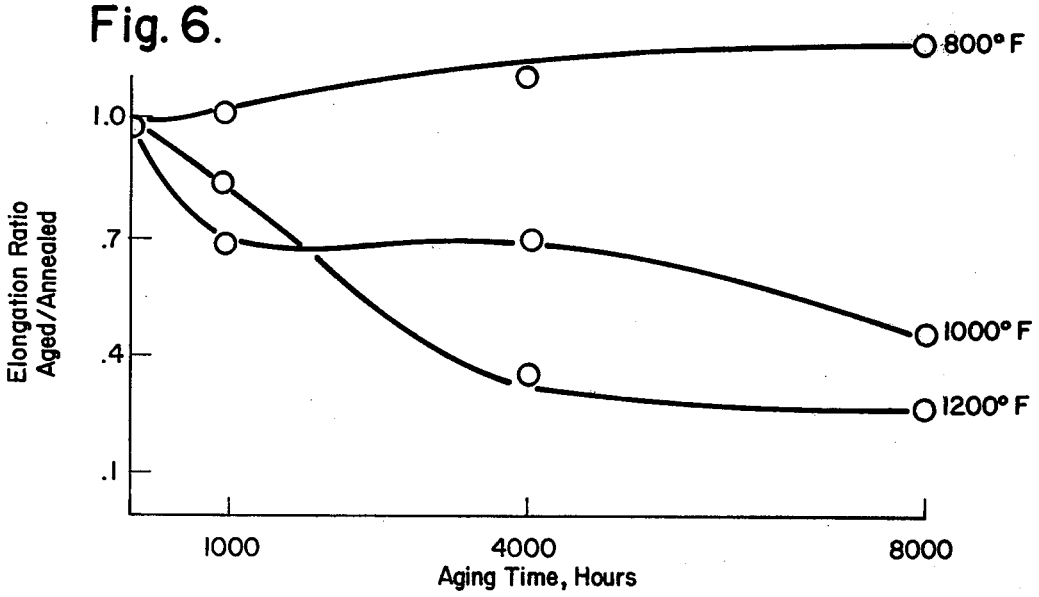
FIG. 6 is a graph of elongation vs aging time for the composition of FIG. 5.

The yield strength values on 8000 hours aging of Alloy 3 plate are plotted on FIG. 1 and the elongation ratio aged/annealed are plotted on FIG. 2. Similarly, the yield strength values on 8000 hours aging of Alloy 2 are plotted on FIG. 3 and the elongation ratio aged/annealed are plotted on FIG. 4. Finally, the yield strength values on Alloy 1 plate are plotted on FIG. 5 along with the elongation ratio aged/annealed on FIG. 6. The data from Tables III, IV and V and FIGS. 1 through 6 illustrate the surprising increase in yield strength on aging in the temperature range 900° F. to 1100° F. while no substantial degradation in ductility occurs.

A plate of Alloy 2 was subjected to a corrosion rate test (Streicher Test) in the annealed and aged conditions. The results are tabulated in Table VI.

TABLE VI.

| Test Piece | Corrosion rate |
|---|---|
| Alloy 2 - Mill Annealed | 128 mpy |
| Alloy 2 - Aged at 1000° F. for 8000 hrs | 212 mpy |

To further explore the suitability of this discovery to increase the strength of Ni-Cr-Mo Alloys at elevated temperatures and to explore the effect of shorter aging times more economically feasible than 8000 hours, a series of tensile tests were conducted on Alloy 2 aged at 1000° F. for only 1 week (168 hours). The results of these tests are given in Table VII along with comparative data for the same Alloy 2 tested in the commercially standard mill annealed condition (1950° F. for 15 minutes and rapid air cooled). The data show that the improvement in strength obtained by proper aging as low as 168 hours are maintained at elevated temperature, illustrating that this invention could be economically useful for parts operating at conditions hotter than ambient temperature. These results suggest that aging for about 50 hours will effect an effective degree of $A_2B$ ordering.

TABLE VII

COMPARATIVE TENSILE TEST DATA FOR ALLOY 2 (.5 Inch Plate)

| Tensile Test Temp ° F | Yield Strength (ksi) Commercial Mill Annealed Condition** | Yield Strength (ksi) This Invention* | Ductility (Elongation %) Commercial Mill Annealed Condition** | Ductility (Elongation %) This Invention* |
|---|---|---|---|---|
| RT | 48.6 | 99.4 | 63.0 | 45.8 |
| 200 | 53.4 | 99.2 | 60.1 | 45.6 |
| 400 | 46.8 | 79.4 | 60.3 | 52.0 |
| 600 | 41.1 | 74.7 | 61.0 | 49.4 |
| 800 | 39.1 | 81.6 | 65.8 | 49.8 |
| 1000 | 36.8 | 69.1 | 61.8 | 48.4 |

*Aged at 1000° F for 1 week (168 hours).
**1950° F for 15 minutes and rapid air cooled.

In the foregoing specification, I have set out certain preferred practices and embodiments of my invention, however, it will be understood that this invention may be otherwise embodied within the scope of the following claims.

I claim:

1. In a process for producing a high strength material having good ductility to provide a ductile, high strength, corrosion resistant alloy, the steps comprising:
   (1) preparing a body of material having a composition consisting essentially of by weight, about 13% to 18% chromium, about 13% to 18% molybdenum, less than 0.01% carbon, less than about 6% iron, less than about 2.50% cobalt, less than about 4% tungsten, less than 0.5% aluminum, less than 1% manganese, less than 0.5% silicon, and the balance nickel with usual transient metals and impurities in ordinary amounts, and
   (2) thereafter aging said body at a temperature in the range about 900° to 1100° F. for at least about fifty hours to effect an $A_2B$ ordering reaction in the composition and an increase in room temperature yield strength at least about 1.5 times the mill annealed strength.

2. In a process as claimed in claim 1 wherein the transient metals include:
   Vanadium less than 0.5%, boron less than 0.02% phosphorous less than 0.05%, sulfur less than 0.02% zirconium less than 0.02%, titanium less than 0.5%, magnesium less than 0.25%, calcium less than 0.025%, copper less than 0.05%, lead less than 0.005% and lanthanum less than 0.025%.

3. In a process as claimed in claim 1 wherein the material is aged at least fifty hours.

4. An alloy body having a high yield strength and good ductility over a wide temperature span and good corrosion resistance consisting essentially of about 13% to 18% chromium, about 13% to 18% molybdenum, less than 0.01% carbon, less than about 6% iron, less than about 2.50% cobalt, less than about 4% tungsten, less than 0.5% aluminum, less than 1% manganese, less than 0.5% silicon and the balance nickel with usual transient metals and impurities in ordinary amounts, said body having been aged at a temperature in the range 900° to 1100° F. for at least about fifty hours to effect an $A_2B$ ordering reaction, and an increase in room temperature yield strength at least about 1.5 times the mill annealed strength.

5. An alloy body as claimed in claim 4 wherein the transient metals include:

Vanadium less than 0.5%, boron less than 0.02% phosphorous less than 0.05%, sulfur less than 0.02% zirconium less than 0.02%, titanium less than 0.5% magnesium less than 0.25%, calcium less than 0.025% copper less than 0.05%, lead less than 0.005% and lanthanum less than 0.025%.

6. An alloy body as claimed in claim 4 which has been aged at least fifty hours.

7. A high yield strength alloy consisting essentially of about 13% to 18% chromium, about 13% to 18% molybdenum, less than 0.01% carbon, less than about 6% iron, less than about 2.50% cobalt, less than about 4% tungsten, less than 0.5% aluminum, less than 1% manganese, less than 0.5% silicon and the balance nickel with usual transient metals and impurities in ordinary amounts, said body having been aged at a temperature in room temperature the range 900° to 1100° F. for at least about fifty hours to effect an $A_2B$ ordering reaction, and an increase in yield strength at least about 1.5 times the mill annealed strength.

8. A high yield strength alloy as claimed in claim 7 wherein the transient metals include:

Vanadium less than 0.5%, boron less than 0.02% phosphorous less than 0.05%, sulfur less than 0.02% zirconium less than 0.02%, titanium less than 0.5%, magnesium less than 0.25%, calcium less than 0.025%, copper less than 0.05%, lead less than 0.005% and lanthanum less than 0.025%.

9. A high yield strength alloy as claimed in claim 7, said alloy being characterized by having been aged for at least 168 hours.

10. A high yield strength alloy as claimed in claim 7 which has been aged at least 50 hours.

* * * * *

UNITED STATES PATENT AND TRADEMARK OFFICE

CERTIFICATE OF CORRECTION

PATENT NO. : 4,129,464
DATED : December 12, 1978
INVENTOR(S) : Steven J. Matthews, H. Joseph Klein and Frank G. Hodge It is certified that error appears in the above-identified patent and that said Letters Patent are hereby corrected as shown below:

Column 3, Table IV, the fourth number under the "Elongation %" column, which is "41.1" should be --42.1--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*